United States Patent [19]

Henricks et al.

[11] Patent Number: 4,481,554

[45] Date of Patent: Nov. 6, 1984

[54] VOLTAGE ADAPTIVE SOLENOID CONTROL APPARATUS

[75] Inventors: Gwenne A. E. Henricks, East Peoria, Ill.; William Pickering, University Heights; Wayne T. Wiblin, Saybrook, both of Ohio

[73] Assignee: Towmotor Corporation, Mentor, Ohio

[21] Appl. No.: 524,271

[22] Filed: Aug. 18, 1983

[51] Int. Cl.[3] ..... H01H 47/22

[52] U.S. Cl. ..... 361/152; 361/187

[58] Field of Search ..... 361/152, 153, 154, 187, 361/195; 307/132 E

[56] References Cited

U.S. PATENT DOCUMENTS

| | | | |
|---|---|---|---|
| 3,237,088 | 2/1966 | Karp et al. | 323/22 |
| 3,549,955 | 12/1970 | Crawford | 317/148.5 |
| 3,579,052 | 5/1971 | Kato et al. | 317/148.5 |
| 3,786,314 | 1/1974 | Misch | 317/154 |
| 3,896,346 | 7/1975 | Ule | 317/154 |
| 4,041,546 | 8/1977 | Stewart | 361/152 |
| 4,059,844 | 11/1977 | Stewart | 361/152 |
| 4,214,290 | 7/1980 | Sloan | 361/187 X |

*Primary Examiner*—Reinhard J. Eisenzopf
*Attorney, Agent, or Firm*—Stephen L. Noe

[57] ABSTRACT

An apparatus (10) is provided for controllably operating at least one solenoid coil (12) in a battery operated system. The mean voltage applied to the coil (12) is controlled in response to at least the battery voltage, facilitating the use of various battery voltages with a single voltage coil (12). The apparatus (10) is readily adapted for controlling multiple coils (12) and is digital in design.

14 Claims, 3 Drawing Figures

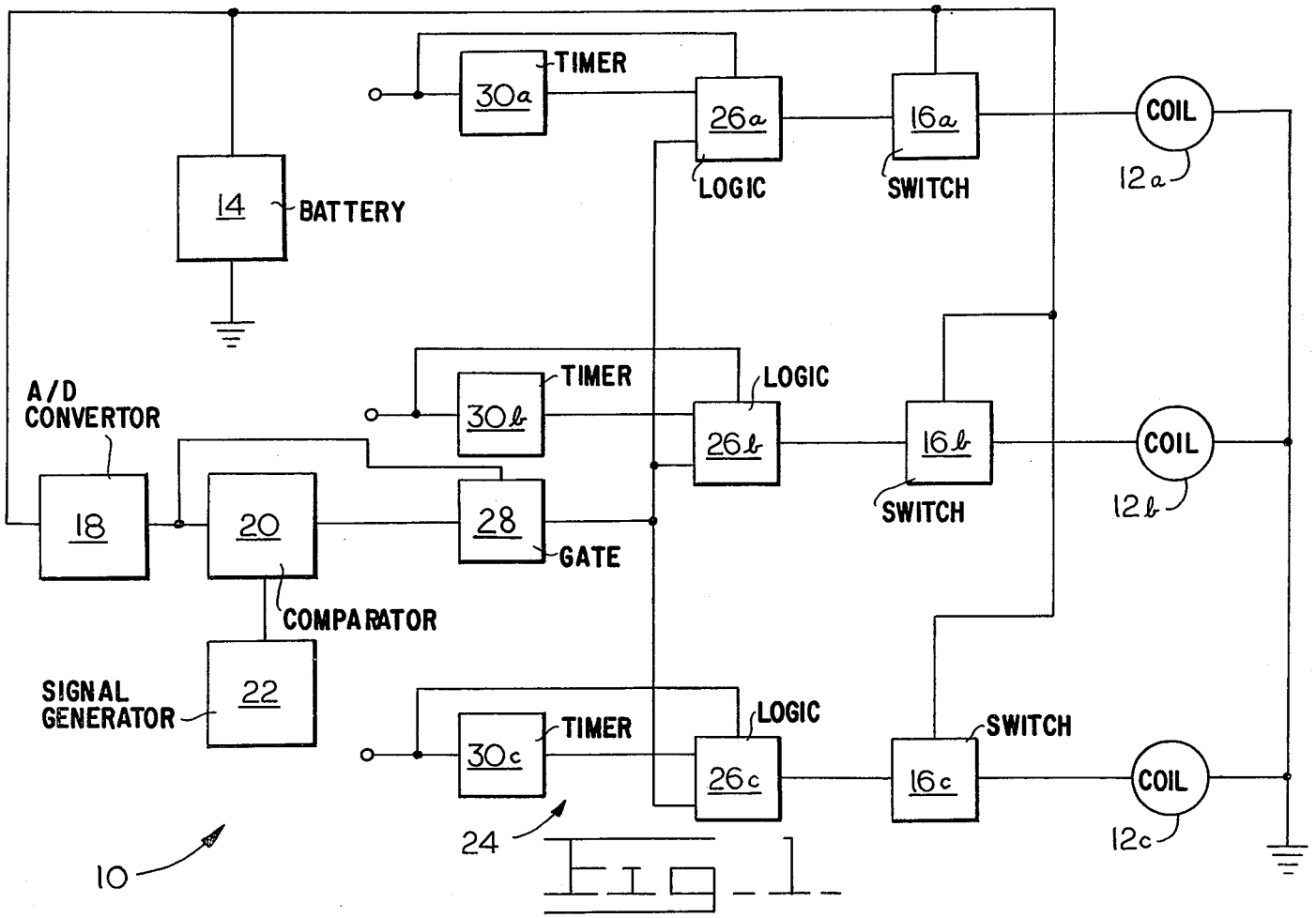
COIL
12a
COIL
12b
COIL
12c
16a
SWITCH
16b
SWITCH
SWITCH
16c
26a
LOGIC
LOGIC
26b
LOGIC
26c
TIMER
30a
TIMER
30b
GATE
28
TIMER
30c
24
BATTERY
14
COMPARATOR
20
22
A/D CONVERTOR
18
SIGNAL GENERATOR
10

MULTIVIBRATOR
COMPARATOR
REGULATOR
$V_{REG}$
$V_{BAT}$
10
14
18
20
22
28
34
38
48
50
52
54
56
58
60
62
64
66
68
70
72
74
76
78
80
82
84
86
88
90
92
94
96
98
100
102
104
106
108
110
112
114
116
118
120
122
124
126
128
130
132
134
136
138
140
142
144
146
148
150
152
154
156
158
160
162
164
166

SIGNAL GENERATOR
$V_{BAT}$

VOLTAGE ADAPTIVE SOLENOID CONTROL APPARATUS

DESCRIPTION

Technical Field

This invention relates generally to an apparatus for controllably operating solenoid coils and, more particularly, to an apparatus for controllably operating at least one solenoid coil in response to a plurality of battery voltages.

Background Art

Numerous industrial and commercial applications utilize a variety of solenoid coils to transform an electrical signal into a mechanical action. For example, an electric vehicle such as an industrial lift truck typically includes a number of contactors for such diverse functions as direction control, motor field shunt, chopper bypass, and regenerative braking. Each of these contactors has a solenoid coil energized by an electrical current.

The voltage and current required to energize these solenoid coils is dictated by the manufacturer and must be considered by the vehicle designers. Contactors are typically manufactured in families, with each member of the family having similar characteristics but varying in the solenoid coil voltage/current drive requirements. Once the voltage of a particular vehicle battery is determined, compatible contactors are selected to be used on the vehicle. Since a single vehicle design often offers battery options ranging from 24 to 72 volts, contactors must be selected for each battery option offered. This requires a large inventory of contactor models and increases the likelihood of manufacturing errors. The ability to utilize a single contactor design with a plurality of battery voltages represents a significant cost savings to manufacturers of lift trucks and other equipment.

In addition to the inventory problems faced by manufacturers, owing to the voltage compatibility issue discussed above, energy consumption and coil longevity are also design considerations. Energy conservation is particularly critical in the electric vehicle industry where the operation time and payload capacity of the vehicle is directly affected by the rate of energy consumption. It is well-known that the power required to initially energize or "pull in" a contactor is significantly greater than the power required to maintain the contactor status after the "pull in" is accomplished. Therefore, it is desirable to employ a two level energization technique for most efficient operation.

Conventionally, solenoid coils are energized by supplying an electrical current at the proper voltage to the coil through either a mechanical or electronic switch. The literature and art in the field has also recognized a more elaborate method of controlling the current through the coil, primarily for purposes of energy conservation and solenoid operating speed. Typical of these are regulator based coil drivers such as described in U.S. Pat. No. 3,549,955 issued on Dec. 22, 1970 to William E. Crawford.

The Crawford patent teaches sensing the actual instantaneous current flowing through the solenoid coil, comparing the sensed current level to a predetermined reference current level, and alternately pulsing the power supplied to the coil in response to the compared levels. The reference current level is selected to provide only the mean current required to maintain the energized status of the coil, making the system energy efficient. However, the maintenance current level is insufficient to insure proper "pull in". So, to permit "pull in" to occur, the Crawford patent teaches applying full battery voltage to the coil for a predetermined time prior to entering the pulsed mode.

The Crawford system, and other similar known designs, provide good energy efficiency, assuming the reference current level is accurately established. However, they fail to address the above-described problems of battery/contactor incompatibility, especially when dealing with multiple contactors. While the current sensing design allows the use of a battery voltage in excess of the design voltage of the solenoid coil, the sensing and control electronics must be duplicated for each coil in the system being controlled. Such duplication is expensive to implement and potentially failure prone. Also, such precise current control is unnecessary in coils designed to operate properly over a relatively wide range of voltage/current characteristics.

Additionally, the known art is basically analog in nature and design, while modern industrial and commercial control equipment is generally of a digital design and is often computer controlled. A suitable solenoid control apparatus is preferably digital, of simple and rugged construction, and capable of functioning with multiple solenoid coils with little increase in expense or complexity.

The present invention is directed to overcoming one or more of the problems as set forth above.

Disclosure of the Invention

In one aspect of the present invention, an apparatus is provided for controllably operating at least one solenoid coil and includes a battery and at least one coil switch. The control apparatus has means for receiving the battery voltage and producing a signal in response to the voltage; means for receiving the signal, comparing it with a reference signal, and producing a predetermined output signal in response to the compared signals; and means for receiving the output signal and a coil command signal and delivering the output signal to the switch in response to receiving the output and command signals.

The present invention facilitates controlling one or more solenoid coils in an energy efficient manner, compensates for a variety of different battery voltage levels, and is advantageously digital in construction and of simple, rugged, and low cost design.

BRIEF DESCRIPTION OF THE DRAWINGS

For a better understanding of the present invention, reference may be made to the accompanying drawings, in which:

FIG. 1 is a block diagram of an embodiment of the present invention; and,

BEST MODE FOR CARRYING OUT THE INVENTION

Figures 2A, 2B:
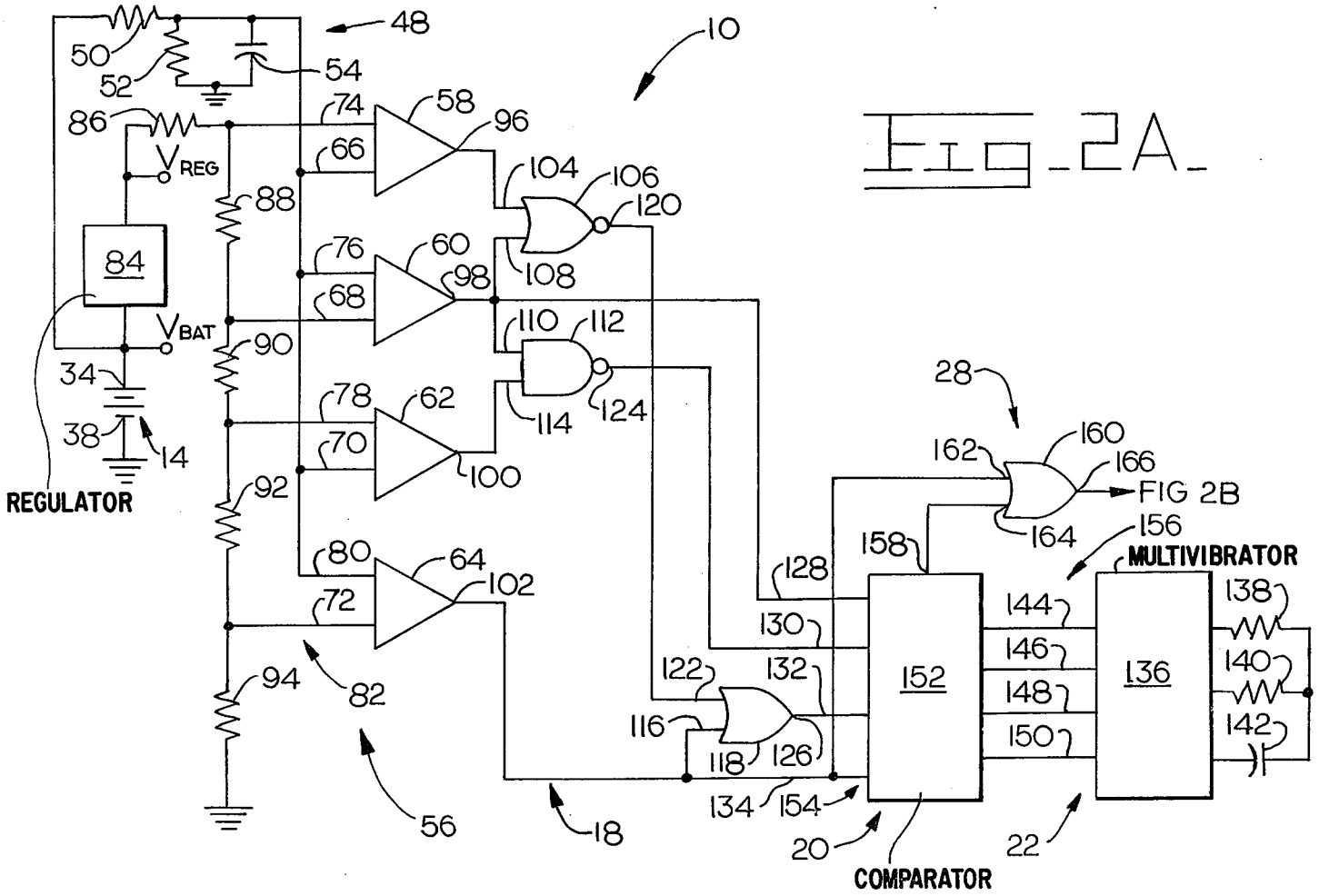
FIGS. 2A and 2B present a detailed schematic diagram of the embodiment of FIG. 1.

Referring first to FIG. 1, an apparatus embodying certain of the principles of the present invention is generally indicated by the reference numeral 10. It should be understood that the following detailed description relates to the best presently known embodiment of the apparatus 10. However, the apparatus 10 can assume numerous other embodiments, as will become apparent to those skilled in the art, without departing from the appended claims.

The apparatus 10 is designed to controllably operate at least one solenoid coil 12. For the purposes of this application, a solenoid coil is defined as an inductive coil that produces a magnetic flux in response to a flow of current through the coil. The coil can be part of a conventional plunger type solenoid, a relay type contactor, or any similar device for transforming an electrical current into mechanical motion of an armature. The solenoid coil 12 is, for example, a portion of a control contactor used in an electric vehicle such as an industrial lift truck. The vehicle can contain any number of such control contactors, each having a solenoid coil 12.

The apparatus 10 includes a battery 14 and at least one coil switch 16. The battery 14 is, for example, the main power source for an electric vehicle and has a nominal voltage rating in the range of 24 to 90 volts DC. The solenoid coil 12 has a nominal voltage rating less than the battery voltage, for example, 20 volts DC. Such coils 12 are typically designed to operate properly over a range of voltages about the nominal voltage, for example, from 17 to 24 volts DC. The battery 14 is controllably connected to the coil 12 through the coil switch 16.

The apparatus 10 includes means 18 for receiving the battery voltage and producing a digital signal in response to the received voltage. A comparator means (20) receives the digital signal, compares the signal with a reference signal received from a reference signal generator 22, and produces a predetermined output signal in response to the compared signals.

Logic means 24 receives the output signal and at least one coil command signal and delivers the output signal to a respective switch 16 in response to receiving both the output and command signal. The command signal is simply an "on/off" command to a respective solenoid coil 12 and can be supplied by a mechanical switch or by a more sophisticated controller, for example, a microprocessor based command signal generator 172 for the vehicle.

The logic means 24 includes at least one logic element 26 associated with the switch 16, and means 28 for continuously energizing the switch 16 in response to receiving the command signal and to the battery voltage having a magnitude less than a predetermined value. The logic means 24 also includes at least one means 30 for receiving the command signal and continuously energizing the switch 16 for a predetermined time in response to receiving the command signal.

The solenoid coil 12 is, for example, part of a relay type contactor for an electric vehicle, and can be one of a plurality of such coils on the vehicle. Therefore, three identical solenoid coils 12 are shown in FIG. 1, differentiated by the lowercase letters (a,b,c) following the element numeral 12. Each coil **12*a*,12*b*,12*c* depicted has associated with it a respective coil switch 16*a*,16*b*,16*c*, logic element 26*a*,26*b*,26*c* and timer means 30*a*,30*b*,30*c*. The apparatus 10** is intended to operate with any number of such sets of elements.

FIGS. 2A and 2B present a detailed schematic representation of the embodiment illustrated in FIG. 1. As with FIG. 1, three solenoid coils **12*a*,12*b*,12*c* and associated elements are shown for exemplary purposes. The coils 12 are, for example, nominal 20 volt DC coils, designed to operate over a voltage range from 17 to 24 volts DC. A first terminal 32 of each coil is connected to a positive terminal 34 of the battery 14. A second terminal 36 of each coil 12 is connected to the respective coil switch 16. In response to the switch 16 being turned "on", the second terminal 36 is connected to a negative terminal 38 of the battery 14 and the coil 12 is energized, and in response to the switch 16 being turned "off", the coil 12** is not energized.

The switches 16 are preferably transistors 40, each transistor 40 having a collector 42 connected to the coil second terminal 36, an emitter 44 connected to the battery negative terminal 38, and a base 46 for receiving a control signal. A low or logic "0" control signal applied to the base 46 turns the respective transistor 40 "off" and a high or logic "1" control signal turns the transistor 40 "on".

The positive battery terminal 34 is also connected to the means 18 through a signal conditioning circuit 48. Circuit 48 includes first and second resistors 50,52 connected as a voltage divider, and a filter capacitor 54. The voltage divider modifies the voltage level delivered to the means 18 and reduces it to a logic signal level, and the capacitor 54 prevents transient voltages from being delivered to the means 18.

The means 18 includes an analog to digital converter 56 having a plurality of voltage magnitude detectors 58,60,62,64, for example, operational amplifiers. Each detector includes a first respective input 66,76,70,80 connected to the battery 14 through the signal conditioning circuit 48, and a second respective input 74,68,78,72 connected to a reference voltage signal source 82. The reference source 82 provides a different predetermined voltage magnitude reference value to each of the second inputs 74,68,78,72 and includes a voltage divider connected through a regulator 84 to the positive battery terminal 34. The junction of each of the series connected resistors 86,88,90,92,94 of the voltage divider is connected to a different respective detector second input 74,68,78,72.

Each detector 58,60,62,64 also includes a respective output 96,98,100,102. The output 96 is connected to a first input 104 of a NOR gate 106. The output 98 is connected to a second input 108 of the gate 106 and to a first input 110 of a NAND gate 112. The output 100 is connected to a second input 114 of the gate 112 and the output 102 is connected to a first input 116 of an OR gate 118. An output 120 of the NOR gate 106 is connected to a second input 122 of the OR gate 118. The NAND gate 112 includes an output 124 and the OR gate 118 includes an output 126. The outputs 98,124,126,102 are connected to respective lines 128,130,132,134 and form a set of means 18 outputs.

The reference signal generator 22 includes a digital counter and an astable multivibrator 136, for example, the Part No. 4060 manufactured by RCA Corporation of Somerville, N.J. The four bit counter is clocked continuously at a rate determined by two external resistors 138,140 and a capacitor 142. In response to being clocked by the multivibrator, the counter continuously delivers a time dependent digital signal that varies in sixteen increments from "0000" to "1111" to a set of output lines 144,146,148,150. Therefore, the reference signal delivered from the generator 22 on the lines 144,146,148,150 is a multi-bit digital signal that varies in response to time.

The comparator means 20 includes a digital comparator 152 having a first set of inputs 154 connected to the respective output lines 128,130,132,134 from the means 18 and a second set of inputs 156 connected to the respective output lines 144,146,148,150 from the reference generator 22. In response to receiving a digital signal on the first set of inputs 154 that is greater than the digital signal received on the second set of inputs 156, the comparator 152 delivers a logic "1" signal to an output 158. At all other times the signal delivered to the output 158 is a logic "0".

The means 28 is an OR gate 160 having a first input 162 connected to the detector output 102 and a second input 164 connected to the comparator output 158. In response to both of the inputs 162,164 being at a logic "0" level, the gate 160 delivers a logic "0" signal to an output 166, and in response to either of the inputs 162,164 being at a logic "1" level, the gate 160 delivers a logic "1" signal to the output 166.

Figures 2A, 2B:
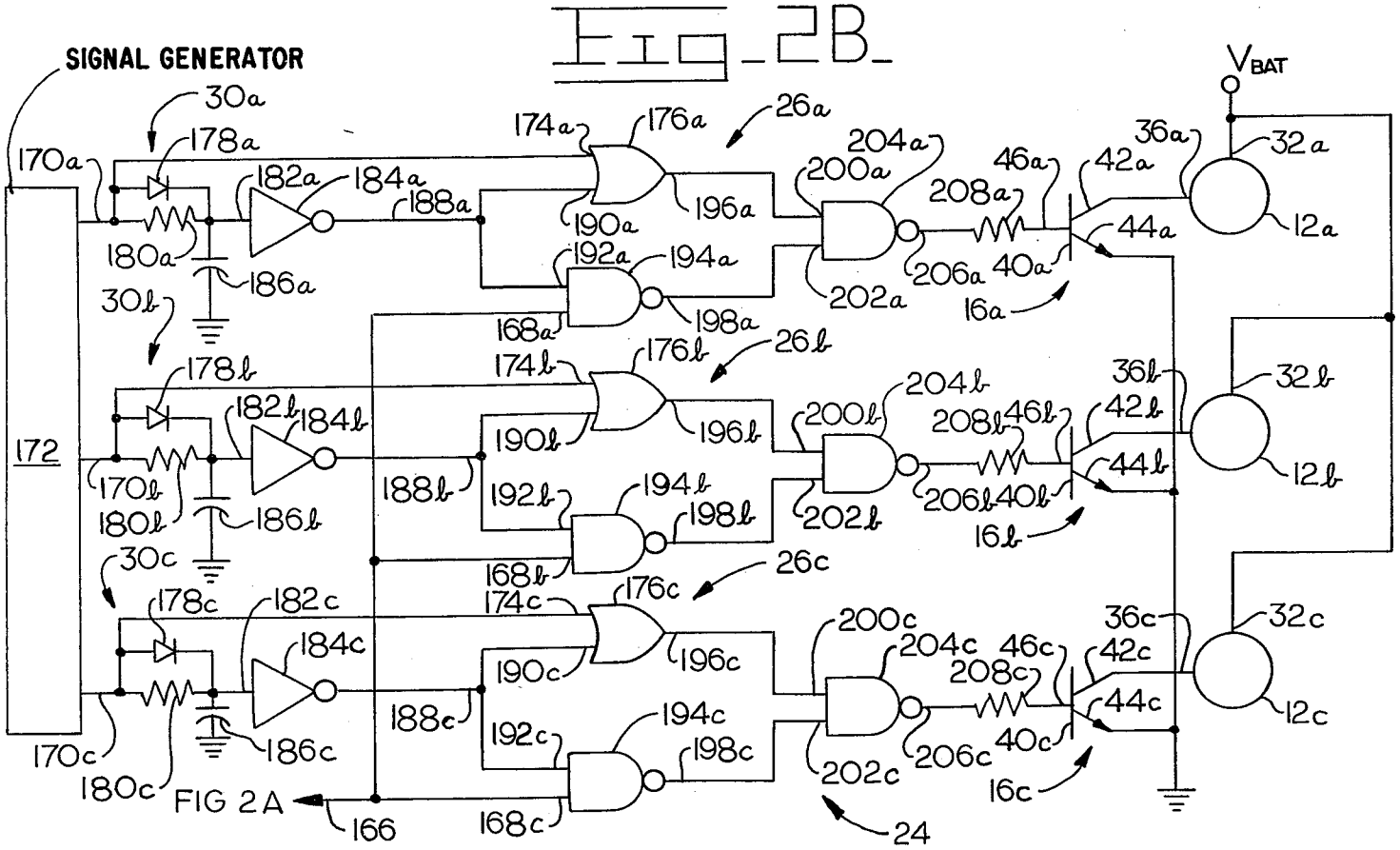

The gate output 166 is connected to a first input 168 of the logic means 24. The logic means 24 includes logic circuits 26 and timer means 30, and comprises a respective set of circuit elements for each solenoid coil 12 to be controlled by the apparatus 10. For exemplary purposes, three sets of elements are shown in FIG. 2, with the element numbers of each set being differentiated one from the other by the lowercase letters (a,b,c) following the respective numbers.

A second input 170 of the logic means 24 is connected to the command signal generator 172, to a first input 174 of an OR gate 176, to the anode of a diode 178, and to a resistor 180. The remaining ends of the diode 178 and resistor 180 are connected to the input 182 of an inverter 184 and to a capacitor 186. The output 188 of the inverter 184 is connected to a second input 190 of the OR gate 176 and to a first input 192 of a NAND gate 194. A second input 168 of the NAND gate 194 is the first input of the means 24 and is connected to the output 166 of the OR gate 160.

Outputs 196,198 of the gates 176,194 are connected to respective inputs 200,202 of a NAND gate 204. The output 206 of the gate 204 is connected through a resistor 208 to the base 46 of the transistor 40.

The ratings and values shown for various electrical elements discussed above are for exemplary purposes only. Alterations of the circuit and embodiment discussed and the use of electrical elements of different constructions or ratings will be readily apparent to those skilled in the art. Such alterations or substitutions can be implemented without departing from the appended claims.

Industrial Applicability

From time to time in the following discussion, reference will be made to Table 1, where the status of various signal lines is depicted.

TABLE 1

| Battery Voltage | Detector Outputs (96, 98, 100, 102) | Comparator Inputs (154) | Output (158) Duty Factor | Output (166) Duty Factor |
|---|---|---|---|---|
| <22.7 | 0101 | 1111 | 94% | 100% |
| >22.7 | 0100 | 1100 | 75% | 75% |
| >32.7 | 0110 | 1000 | 50% | 50% |
| >45.5 | 0010 | 0110 | 37.5% | 37.5% |
| >63.6 | 1010 | 0100 | 25% | 25% |

Assume, for example, that the apparatus 10 is part of an electric vehicle such as a lift truck, that the solenoid coils 12 are portions of various control contactors of the truck and are designed for normal operation over a voltage range of 17 to 24 volts DC, and that the battery 14 is a 48 volt DC storage battery.

The voltage regulator 84 supplies a constant voltage to the reference source 82, which, in turn, supplies a different predetermined magnitude reference value to each of the detectors 58,60,62,64. Battery voltage is also supplied to each of the detectors 58,60,62,64 after being modified by the signal conditioning circuit 48. The reference values selected are established according to standard battery voltage ratings. In response to a battery voltage of 48 volts, the detector outputs 96,98,100,102 are at respective logic levels of "0010". Other combinations of battery voltages and detector output signals are shown in Table 1.

The logic signals from the detector outputs 96,98,100,102 are received by the gates 106,112,118 and logically combined to form a four bit digital signal that varies in response to the battery voltage. In response to the battery voltage of 48 volts, the digital signal delivered to the first set of comparator inputs 154 is "0110". Other digital signals delivered to the inputs 154 are shown in Table 1.

The second set of comparator inputs 156 receives a four bit digital signal from the reference signal generator 22 that continuously varies with time, in increments from "0000" to "1111". The rate at which the signal is clocked is determined by the resistors 138,140 and the capacitor 142. The comparator 152 delivers a logic "1" signal on output 158 in response to the signal on the first set of inputs 154 being greater than the signal on the second set of inputs 156 and delivers a logic "0" at all other times. Owing to the cyclical clocking of the signal on the second set of inputs 156, the signal delivered to the output 158 is a pulse train having a duty factor responsive to the compared signals. The duty factor is defined as the proportion of pulse "on" or logic "1" time, to pulse "off" or logic "0" time. In response to the 48 volt battery voltage, the duty factor is 37.5%. Other battery voltages and responsive pulse train duty factors are shown in Table 1.

As shown in the Table, the pulse train varies inversely with the battery voltage. With a battery voltage less than 22.5 volts, the maximum duty factor signal of 94% is delivered to the output 158. The OR gate 160 of the means 28 receives the signal from the output 158 and the signal from the detector output 102, modifies the pulse train, and delivers a continuous logic "1" or 100% duty factor signal to the output 166 in response to the battery voltage being less than the predetermined value. The pulse train duty factor delivered to the output 166 is shown in Table 1.

Therefore, in response to the above-described circuitry, a pulse train is continuously delivered to the first input 168 of the logic means 24. The duty factor of the delivered pulse train varies in response to the voltage supplied by the battery 14. As shown in the Figures, the same predetermined pulse train is delivered to each of the first inputs 168, regardless of the number of solenoid coils 12 to be controlled by the apparatus 10.

The second input 170 of the logic means 24 receives a solenoid command signal from the command generator 172. The command signal is a logic "0" to energize a particular solenoid coil 12 and a logic "1" to deenergize the coil 12. The signal generator is, for example, an electronic controller of an electric lift truck, but can be any other type of command generator, even a simple mechanical switch.

Assuming that the input 170 is a logic "1", the capacitor 186 quickly charges to a logic "1" through the diode 178, and the inverter 184 delivers a logic "0" to the output 188. The logic "0" is delivered to the first input 192 of the NAND gate 194, blocking the pulse train from passing through the NAND gate 194 and producing a continuous logic "1" at the output 198. The OR gate 176 receives the logic "0" from the inverter 184 and the logic "1" command signal and delivers a logic "1" signal to the output 196. In response to receiving both logic "1" signals from the outputs 196,198, the NAND gate 204 delivers a logic "0" signal to the output 206 and to the switch 16, turning "off" the transistor 40 and deenergizing the respective solenoid coil 12.

In response to the command signal switching to a logic "0" at the output 170, the capacitor 186 begins to discharge through the resistor 180 at a rate determined by the time constant of the resistor 180 and capacitor 186 combination. For the duration of the discharge period, both inputs 174,190 of the OR gate 176 are a logic "0", the output 196 switches to a logic "0", and the output 206 of the NAND gate 204 switches to a logic "1", turning "on" the transistor 40 and energizing the coil 12 at full battery voltage. The initial application of full battery voltage to the coil 12 insures that coil "pull in" occurs.

As the capacitor 186 discharges, the output 188 of the inverter 184 eventually switches to a logic "1" which is delivered to the input 192 of the NAND gate 194. In response to the logic "1" on the input 192, the gate 194 delivers the pulse train on the input 168 to the output 198 and to the NAND gate 204. The OR gate 176 continues to deliver the logic "1" to the other input 200 of the gate 204 and the pulse train is delivered to the switch 16. In response to receiving the pulse train, the transistor 40 controllably delivers current to the solenoid coil 12 from the battery 14 according to the pulse train duty factor.

Although the operation of the logic means 24 has been described as one command signal operating a single solenoid coil 12, it is evident that, as shown in the Figures, a plurality of coils 12 can be readily controlled by the apparatus 10.

Other aspects, objects, advantages, and uses of this invention can be obtained from a study of the drawings, the disclosure, and the appended claims.

We claim:

1. In an apparatus (10) for controllably operating at least one solenoid coil (12), said apparatus (10) including a battery (14) and at least one coil switch (16), the improvement comprising:

means (18) for receiving the battery voltage and producing a digital signal in response to said received voltage;

means (20) for receiving said digital signal, comparing said signal with a multi-bit digital reference signal, and producing a predetermined output signal in response to said compared signals; and, logic means (24) for receiving said predetermined output signal and at least one coil command signal and delivering said output signal to at least one of said switches (16) in response to receiving both of said output and command signals.

2. An apparatus (10), as set forth in claim 1, wherein said means (18) for receiving the battery voltage includes a plurality of voltage magnitude detectors (58,60,62,64), each having a predetermined magnitude reference value.

3. An apparatus (10), as set forth in claim 1, wherein said reference signal varies in response to time.

4. An apparatus (10), as set forth in claim 3, wherein said predetermined output signal is a pulse train having a duty factor responsive to said compared signals.

5. An apparatus (10), as set forth in claim 4, wherein said duty factor varies inversely with said battery voltage.

6. An apparatus (10), as set forth in claim 1, including at least one means (30) for receiving said coil command signal and continuously energizing said switch (16) for a predetermined time in response to receiving said command signal.

7. An apparatus (10), as set forth in claim 1, including means (28) for continuously energizing said switch (16) in response to receiving said command signal and to said battery voltage having a magnitude less than a predetermined value.

8. An apparatus (10), as set forth in claim 1, including a plurality of coils (12), each of said coils (12) having a respective coil switch (16) and logic element (26).

9. An apparatus (10), as set forth in claim 8, wherein the same predetermined output signal and a different coil command signal is delivered to each of said logic elements (26).

10. An apparatus (10) for operating at least one solenoid coil (12), said coil (12) being controllably connected to a battery (14) through a coil switch (16), comprising:

an analog to digital converter (56) having an input (66,68,70,72) connected to said battery (14), and a set of outputs (98,124,126,102);

a digital comparator (152) having a first set of inputs (154) connected to said converter outputs (98,124,126,102), a second set of inputs (156) connected to a digital reference signal generator (22), and an output (158); and, a logic circuit (26) having a first input (168) connected to said comparator output (158), a second input (170) connected to a command signal generator (172), and an output (206) connected to said coil switch (16).

11. An apparatus (10), as set forth in claim 10, wherein said analog to digital converter (56) includes a plurality of voltage magnitude comparators (58,60,62,64), each of said comparators (58,60,62,64) having a first input (66,68,70,72) connected to said battery (14) and a second input (74,76,78,80) connected to a different reference voltage source (82), and an output (96,98,100,102); and, a plurality of logic gates (106,112,118) having inputs (104,108,110,114,116) connected to said comparator outputs (96,98,100,102) and outputs (124,126) connected to said comparator first inputs (154).

12. An apparatus (10), as set forth in claim 10, wherein said reference signal generator (22) includes a digital counter (136).

13. An apparatus (10), as set forth in claim 10, wherein said logic circuit second input (170) includes a time delay circuit (30).

14. An apparatus (10), as set forth in claim 10, including a plurality of solenoid coils (12), each of said coils (12) having a respective coil switch (16) and logic circuit (26), each of said logic circuits (26) having an output (206) connected to the respective switch (16), a first input (168) connected to said comparator (152) and a second input (170) connected to a command circuit generator (172).

* * * * *